US007067684B2

(12) United States Patent
Westfechtel et al.

(10) Patent No.: US 7,067,684 B2
(45) Date of Patent: Jun. 27, 2006

(54) PROCESSES FOR THE PRODUCTION OF TRIGLYCERIDES OF CONJUGATED LINOLEIC ACID

(75) Inventors: Alfred Westfechtel, Hilden (DE); Stefan Busch, Oberhausen (DE); Elke Grundt, Duesseldorf (DE); Peter Horlacher, Bellenberg (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 11/013,834

(22) Filed: Dec. 16, 2004

(65) Prior Publication Data

US 2005/0171368 A1 Aug. 4, 2005

(30) Foreign Application Priority Data

Dec. 16, 2003 (DE) ..... 103 58 826

(51) Int. Cl.
*C11C 3/00* (2006.01)

(52) U.S. Cl. ..... 554/169

(58) Field of Classification Search ..... 554/169
See application file for complete search history.

(56) References Cited

U.S. PATENT DOCUMENTS 5,434,278 A * 7/1995 Pelloso et al. ..... 554/165
6,124,486 A 9/2000 Cherwin et al.

FOREIGN PATENT DOCUMENTS

WO WO 90/12858 A1 11/1990
WO WO 94/18290 A1 8/1994

OTHER PUBLICATIONS

Roach et al., "Chromatographic Separation And Identification Of Conjugated Linoleic Acid Isomers", Analytica Chimica Acta, 465, Elsevier Science B.V., (2002), pp. 207-226.

Eulitz et al., Preparation, Separation And Confirmation Of The Eight Geometrical cis/trans Conjugated Linoleic Acid Isomers 8,10- Through 11,13-18:2; LIPIDS, vol. 34, No. 8, (1999), pp. 873-877.

* cited by examiner

*Primary Examiner*—Deborah D. Carr
(74) *Attorney, Agent, or Firm*—John F. Daniels

(57) ABSTRACT

Processes for preparing conjugated linoleic acid triglycerides are described which comprise: (a) providing a conjugated linoleic acid alkyl ester, wherein the alkyl group is linear or branched and has from 1 to 5 carbon atoms; and (b) subjecting conjugated linoleic acid alkyl ester to transesterification with triacetin to provide a conjugated linoleic acid triglyceride.

20 Claims, No Drawings

PROCESSES FOR THE PRODUCTION OF TRIGLYCERIDES OF CONJUGATED LINOLEIC ACID

BACKGROUND OF THE INVENTION

The class of "conjugated linoleic acids" (CLA=conjugated linoleic acid) comprises numerous isomers of C18:2 fatty acids of which the double bonds form a conjugated p-system. An analytical separation of the isomers was recently described in ANALYTICA CHIMICA ACTA: Chromatographic separation and identification of conjugated linoleic acid isomers: Roach, J. A. G., Mossoba, M. M., Yurawecz, M. P., Kramer, J. K. G.; 465 (1–2): 207–226, Aug. 16, 2002. Whereas natural sources, such as dairy products, mainly contain the c9,t11-isomer (pansenoic acid), commercial syntheses normally yield a 1:1 mixture of c9,t11- and t10,c12-isomer. Both isomers show specific physiological activities, for example preference for muscle development over the replacement of fatty tissue, strengthening of the immune system, positive effects on bone development and anticarcinogenic activity. The described properties make a mixture of these two isomers particularly interesting for use as food additives. However, a basic requirement for use in this field is high isomer purity, i.e. the absence of unwanted CLA isomers—especially the c11,t13-CLA and trans, trans-CLAs. These are formed at temperatures above 130° C. by isomerization of c9,t11- and t10, c12-CLA.

All the industrial processes presently used for the production of CLA provide them in the form of the free acid or its esters. However, fatty acids are naturally taken up mainly as fats and oils and, even in food supplementation, the triglyceride is the preferred CLA derivative. Besides far better sensory properties, its very considerable structural and physical similarity to conventional triglycerides—especially oils rich in linoleic acid, such as thistle oil and sunflower oil—provides for ready incorporation in a number of fat-containing preparations. In addition, triglycerides are far more stable to oxidation than the corresponding free fatty acids.

Since there is no known process for isomerizing linoleic acid groups of an oil with the triglyceride structure intact, CLA triglycerides are currently produced by transesterification of CLA/CLA esters and glycerol. For the reasons described above, this requires relatively mild conditions under which only enzymatic catalysts presently show adequate activity. However, serious disadvantages of these enzyme-catalyzed reactions are the long reaction time of several days, very high enzyme costs and the difficulties involved in handling the enzyme. The lipase-catalyzed inter-esterification of long-chain fatty acids or alkyl esters thereof with triglycerides of short-chain fatty acids is known, for example, from WO 90/12858.

Many processes for the production of acetoglycerides, more particularly stearyl acetyl glycerides, are based on the transesterification of corresponding fats with triacetin (triacetyl glyceride). The catalysts used are mainly metal soaps. In some cases, the reactions are carried out at 200 to 260° C., as described in U.S. Pat. No. 6,124,486. At lower temperatures, the poor miscibility of the triacetin with triglycerides carrying long-chain fatty acids (C16–C22) leads to significant losses of reactivity and hence yield. This limitation can be avoided by the addition of C3–C10 triglycerides. International patent application WO 94/18290 and U.S. Pat. No. 5,434,278 disclose the inter-esterification of triacetin and triglycerides with long-chain C16–C22 fatty acid residues to form mixed triglycerides with long-chain and short-chain fatty acid residues, characterized in that triglycerides containing saturated C3–C10 fatty acid residues are added to the reaction. In this way, the reaction takes place rapidly in a single phase, without solvents and without intensive mixing.

Accordingly, the problem addressed by the present invention was to provide a process for the production of CLA triglycerides which would be distinguished by high profitability as reflected in short reaction times, high yields and inexpensive starting materials. The CLA triglycerides formed would have high isomer purity, i.e. a low content of trans, trans isomers and c11, t13 isomers.

SUMMARY OF THE INVENTION

The present invention relates, in general, to fatty acid esters and, more particularly, to a new process for the production of esters of conjugated linoleic acid with glycerol by transesterification.

One embodiment of the present invention relates to a chemical process for the production of triglycerides of conjugated linoleic acid (CLA triglycerides), in which linoleic acid alkyl esters containing a linear or branched alkyl group with 1 to 5 carbon atoms are transesterified in the presence of triacetin (triacetyl glyceride).

The synthesis is carried out by transesterification of a CLA alkyl ester, preferably methyl and ethyl ester, of appropriate quality (food grade) with triacetin. Suitable catalysts are bases, preferably alkali metal alcoholates and more particularly sodium methanolate. The sodium methanolate may be used both in solid form and in solution in the corresponding alcohol. Although the reaction proceeds successfully even when stoichiometric quantities of the educts are used, the yield of CLA triglyceride can be increased by using an excess of CLA ester over the quantity of triacetin, preferably a 10 to 30% excess and more particularly a 20% excess of the CLA ester.

Surprisingly, the necessary quantity of triacetin is completely soluble in the CLA ester and the process can be carried out in a single phase. Accordingly, high reaction temperatures, the use of high-performance stirrers and the use of solubilizers or solvents, as known from the prior art, are unnecessary, even at low reaction temperatures.

DETAILED DESCRIPTION OF THE INVENTION

The chemical production of the CLA triglyceride by trans-esterification of triacetin and a CLA alkyl ester takes only a few hours in the presence of catalytic quantities of an alkoxide. The reaction temperature is in the range from 90 to 160° C., preferably in the range from 100 to 140° C. and more particularly in the range from 120 to 130° C. At a reaction temperature of 130° C., the reaction is over after about 3 hours. After working up, unreacted CLA ester can be separated almost completely from CLA glycerides by short-path distillation.

Surprisingly, it has also been found that the isomer pattern in the CLA triglyceride corresponds to that of the CLA alkyl ester used (see Table 1) although alkoxides do represent effective isomerization catalysts at 130° C. Under the selected conditions, there would appear to be no unwanted secondary isomerizations; the isomer pattern of the fatty acid remains unchanged. This means that the content for each of the C18:2 isomers after the transesterification reaction should not differ by more than 3, preferably 1 and more particularly 0.5 area-% from the value of the isomers used, as measured by the method developed by Eulitz et al. (see Table 3c). This is remarkable because alkoxides—methanolate and ethanolate in particular—are among the most effective isomerization catalysts of all and are commercially used for the synthesis of the CLA methyl and ethyl esters. The absence of unwanted CLA isomers in the product represents a key quality criterion. Unwanted isomers are understood to be C18:2 trans, trans isomers of which the increase by the process according to the invention is intended to be at most 0.5, preferably 0.3 and more particularly 0.2 area-% (see Table 3c where the increase is 0.1 area-%) in relation to the starting product. Other unwanted isomers are c11, t13 isomers—in animal tests, an accumulation of these isomers was detected in pigs' hearts. They are determined by the silver ion—HPLC—method of Eulitz et al. (see Table 3c) and should be present in the CLA triglyceride in a maximum quantity of 0.5, preferably 0.3 and more particularly 0.1 area-%.

In contrast to enzymatic processes, the catalysts do not have to be repeatedly re-used by virtue of their low cost which considerably simplifies handling. In addition, a far shorter reaction time is needed.

Given optimal reaction management, yields of more than 80% CLA triglyceride can be achieved. Remarkably, the only other main component of the product found was not the expected di-CLA-monoacetyl triglyceride (the result of the double transesterification of triacetin and CLA ester), but rather the CLA diglyceride. Acetyl groups and free acetic acid could only be detected in extremely small quantities in the reaction product, even by HPLC. This has significant positive effects on product quality. On the one hand, there is no risk of acetic acid being released under adverse storage conditions which would seriously impair inter alia the sensory properties of the product. On the other hand, a mixture of CLA diglyceride and triglyceride largely corresponds to natural oils which makes it safe to use as a food supplement.

After short-path distillation and purification in a thin-layer evaporator, a CLA glyceride mixture of tri- and diglycerides with very small traces of monoglyceride is obtained. The quantity of triglycerides is intended to be at least 70% and preferably 75% while the quantity of monoglycerides is intended to be at most 1% and preferably at most 0.5%, based on the total quantity of CLA glycerides.

The starting materials used for the process according to the invention are conjugated linoleic acid alkyl esters which preferably correspond to formula (I):

$$R^1CO—OR^2 \quad (I)$$

where $R^1CO$ is the acyl residue of a conjugated linoleic acid and $R^2$ is a linear or branched alkyl group containing 1 to 5 carbon atoms. Conjugated linoleic acid methyl and/or ethyl ester are particularly preferred.

The term "conjugated linoleic acid" in the context of the invention preferably encompasses the main isomers 9cis, 11trans octadecadienoic acid and 10trans, 12cis and also any of the isomer mixtures which normally accumulate in the production of conjugated linoleic acid.

The catalysts used are bases, preferably alkali metal alcoholates such as, for example, sodium methanolate, sodium ethanolate, sodium propanolate, sodium butanolate, potassium methanolate, potassium ethanolate, potassium propanolate, potassium butanolate. The alcoholates may be used both in solid form and in solution in the corresponding alcohol.

EXAMPLES

Production of Triglycerides of Conjugated Linoleic Acid:

Example 1

Reaction of CLA Methyl Ester with Triacetin Using Methanolate Solution:

TABLE 1a

| Starting materials | | |
|---|---|---|
| Material | Quantity [mol] | Weight [g] |
| CLA methyl ester | 1.0 | 292.4 |
| Triacetin | 0.3 | 65.5 |
| Sodium methanolate solution (30% in methanol) | 0.04 (NaOMe) | 7.2 (solution) |
| Citric acid | 0.02 | 4.2 |

After drying of the methyl ester and triacetin (vacuum, 120° C., 30 mins.), catalyst solution is added under nitrogen at 90° C. On subsequent heating to 130° C., methyl acetate distils off. After about 1 hour, vacuum is applied and the whole is stirred for another 3 h. The product is then neutralized with citric acid at 80° C., washed repeatedly with 150 ml hot water, dried (vacuum, 120° C., 30 mins.) and filtered.

TABLE 1b

| Characteristic values of CLA triglyceride | | | |
|---|---|---|---|
| | | | Unit |
| Oleochem. characteristics | Acid value | 2.1 | mg KOH/g |
| | Saponification value | 189 | mg KOH/g |
| | Hydroxyl value | 15.7 | mg KOH/g |
| | Iodine value | 134 | |
| Composition | CLA methyl ester | 26.5 | % |
| | Mono-/di-/triglyceride | 0.8/14.6/55.7 | % |

Example 2

Reaction of CLA Methyl Ester with Triacetin Using Solid Methanolate:

TABLE 2a

| Starting materials | | |
|---|---|---|
| Material | Quantity [mol] | Weight [g] |
| CLA methyl ester | 1.0 | 292.4 |
| Triacetin | 0.3 | 65.5 |
| Sodium methanolate, solid | 0.04 | 2.2 |
| Citric acid | 0.02 | 4.2 |

After drying of the methyl ester and triacetin (vacuum, 120° C., 30 mins.), catalyst is added under nitrogen at 90° C. On subsequent heating to 130° C., methyl acetate distils off. After about 1 hour, vacuum is applied and the whole is stirred for another 3 h. The product is then neutralized with citric acid at 80° C., washed repeatedly with 150 ml hot water, dried (vacuum, 120° C., 30 mins.) and filtered.

TABLE 2b

| Characteristic values of CLA triglyceride | | | Unit |
|---|---|---|---|
| Oleochem. characteristics | Acid value | 3.2 | mg KOH/g |
| | Hydroxyl value | 8.1 | mg KOH/g |
| Composition | CLA methyl ester | 25.9 | % |
| | Mono-/di-/triglyceride | 0.9/9.5/61.6 | % |

Example 3

Reaction of CLA Ethyl Ester with Triacetin Using Methanolate Solution, Incl. Short-path Distillation for Purification:

TABLE 3a

| Starting Materials | | |
|---|---|---|
| Material | Quantity [mol] | Weight [g] |
| CLA ethyl ester | 15.1 | 4637 |
| Triacetin | 4.6 | 995 |
| Sodium methanolate solution (30% in methanol) | 0.63 (NaOMe) | 112.6 (solution) |
| Citric acid, water-free | 0.3 | 60 |
| Water, demin. | | 120 |
| Becolite ® 5000 filter aid Supplier: Begerow, Germany | | 23 |

After drying of the ethyl ester and triacetin (<30 mbar, 80° C., 30 mins.), catalyst is added under nitrogen at 80° C. On subsequent heating to 130° C., ethyl acetate distils off. After about 1 hour, vacuum is applied (up to <30 mbar) and the whole is stirred for another 3 h. The product is then neutralized at 80° C. with citric acid dissolved in 120 g demineralized water, stirred for 10 mins. at 80° C. and the filter aid added. After drying (<30 mbar, 80° C., 30 mins.) and filtration, the crude product accumulates as a yellow oil. The CLA ethyl ester present therein is removed by short-path distillation and the oil obtained is purified in a thin-layer evaporator. After these purification steps, triglyceride yields of at least 70%, based on the total percentage of CLA glycerides, are obtained.

TABLE 3b

| Characteristics of CLA triglyceride | | Value | Unit |
|---|---|---|---|
| General | Yield | 3237 | g |
| Oleochem. characteristics | Acid value | 0.06 | mg KOH/g |
| | Saponification value | 190.6 | mg KOH/g |
| | Iodine value | 165.7 | |
| | Peroxide value | 0.2 | |
| | Gardner | 4 | |
| | Unsaponifiables | <0.1 | % |
| Composition | Mono-/di-/triglyceride | 0.3/18.9/77.8 | Area- % |
| | Glycerol free | <0.1 | Area- % |
| | Fatty acid ethyl ester | 0.8 | Area- % |
| | Oligomers | 0.4 | Area- % |
| | Acetic acid free | <0.2 | wt.- % |
| | Acetic acid bound | <0.1 | wt.- % |

Table 3c. Comparison of the fatty acid distribution in the educt (CLA ethyl ester) and product (CLA di-/triglyceride) in the process using triacetin (Example 3).

The isomer distribution of the CLA triglycerides was determined by the HPLC methods described in LIPIDS, Preparation, separation and confirmation of the eight geometrical cis/trans conjugated linoleic acid isomers 8,10- through 11, 13–18: 2; Eulitz, K., Yurawecz, M. P., Sehat, N., Fritsche, J., Roach, J. A. G., Mossoba, M. M., Kramer, J. K. G., Adlof, R. O., Ku, Y., 34 (8): 873–877, August 1999.

| Fatty acid | Educt (CLA-EE) | Product (CLA-TG) | Unit |
|---|---|---|---|
| C16:0 | 1.3 | 1.2 | Area- % |
| C18:0 | 2.7 | 2.8 | Area- % |
| C18:1 c9 | 14.0 | 12.8 | Area- % |
| C18:2 c9, c12 | 0.2 | 0.1 | Area- % |
| C18:2 conj., total | 80.5 | 80.8 | Area- % |
| C18:2 conj., c9, t11 | 39.8 | 39.8 | Area- % |
| C18:2 conj., t10, c12 | 38.7 | 38.7 | Area- % |
| C18:2 conj., t8, c10 | — | <0.1 | Area- % |
| C18:2 conj., c11, t13 | — | 0.1 | Area- % |
| C18:2 conj., c, c-isomers | 0.9 | 1.0 | Area- % |
| C18:2 conj., t, t-isomers | 1.0 | 1.1 | Area- % |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A process comprising:

(a) providing a conjugated linoleic acid alkyl ester, wherein the alkyl group is linear or branched and has from 1 to 5 carbon atoms; and (b) subjecting conjugated linoleic acid alkyl ester to transesterification with triacetin to provide a conjugated linoleic acid triglyceride.

2. The process according to claim 1, wherein the conjugated linoleic acid ester comprises a compound selected from the group consisting of conjugated linoleic acid methyl esters, conjugated linoleic acid ethyl esters and mixtures thereof.

3. The process according to claim 1, wherein the conjugated linoleic acid ester comprises a conjugated linoleic acid methyl ester.

4. The process according to claim 1, wherein the conjugated linoleic acid ester comprises a conjugated linoleic acid ethyl ester.

5. The process according to claim 1, wherein the transesterification is carried out in the presence of an alkali metal alkoxylate catalyst.

6. The process according to claim 2, wherein the transesterification is carried out in the presence of an alkali metal alkoxylate catalyst.

7. The process according to claim 6, wherein the alkali metal alkoxylate catalyst is selected from the group consisting of sodium methanolate, sodium ethanolate, sodium propanolate, sodium butanolate, potassium methanolate, potassium ethanolate, potassium propanolate, potassium butanolate and mixtures thereof.

8. The process according to claim 1, wherein the transesterification is carried out in the presence of a sodium methanolate catalyst.

9. The process according to claim 2, wherein the transesterification is carried out in the presence of a sodium methanolate catalyst.

10. The process according to claim 1, wherein the transesterification is carried out at a temperature of from 90 to 160° C.

11. The process according to claim 2, wherein the transesterification is carried out at a temperature of from 90 to 160° C.

12. The process according to claim 5, wherein the transesterification is carried out at a temperature of from 90 to 160° C.

13. The process according to claim 6, wherein the transesterification is carried out at a temperature of from 90 to 160° C.

14. The process according to claim 1, wherein the conjugated linoleic acid alkyl ester is present in a 10 to 30% molar excess based on the triacetin.

15. The process according to claim 2, wherein the conjugated linoleic acid alkyl ester is present in a 10 to 30% molar excess based on the triacetin.

16. The process according to claim 5, wherein the conjugated linoleic acid alkyl ester is present in a 10 to 30% molar excess based on the triacetin.

17. The process according to claim 1, further comprising short-path distillation of the conjugated linoleic acid triglyceride.

18. A process comprising:

(a) providing a conjugated linoleic acid alkyl ester selected from the group consisting of conjugated linoleic acid methyl esters, conjugated linoleic acid ethyl esters and mixtures thereof; and (b) subjecting conjugated linoleic acid alkyl ester to transesterification with triacetin in the presence of an alkali metal alkoxylate catalyst selected from the group consisting of sodium methanolate, sodium ethanolate, sodium propanolate, sodium butanolate, potassium methanolate, potassium ethanolate, potassium propanolate, potassium butanolate and mixtures thereof, wherein the conjugated linoleic acid alkyl ester is present in a 10 to 30% molar excess based on the triacetin, and wherein the transesterification is carried out at a temperature of from 90 to 160° C., to provide a conjugated linoleic acid triglyceride.

19. A conjugated linoleic acid triglyceride prepared by the process according to claim 1.

20. A conjugated linoleic acid triglyceride prepared by the process according to claim 18.

* * * * *